US005280712A

United States Patent [19]

Nakamori et al.

[11] Patent Number: 5,280,712

[45] Date of Patent: Jan. 25, 1994

[54] FLAT KNITTING MACHINE WITH SWING SINKERS AND PRESSER BARS

[75] Inventors: Toshinori Nakamori; Masahiro Yabuta; Minoru Sonomura, all of Wakayama, Japan

[73] Assignee: Shima Seiki Mfg., Ltd., Wakayama, Japan

[21] Appl. No.: 745,291

[22] Filed: Aug. 15, 1991

[30] Foreign Application Priority Data

Aug. 22, 1990 [JP] Japan ..... 2-222245

[51] Int. Cl.[5] ..... D04B 15/10

[52] U.S. Cl. ..... 66/106; 66/109

[58] Field of Search ..... 66/109, 104, 105, 106, 66/107, 110, 206, 62, 64, 75.1, 95, 96 R, 147

[56] References Cited

U.S. PATENT DOCUMENTS

| | | | |
|---|---|---|---|
| 2,687,027 | 8/1954 | Merkel | 66/206 |
| 3,320,773 | 5/1967 | Start et al. | 66/109 |
| 3,326,017 | 6/1987 | Tschümperlin | 66/64 |
| 3,466,898 | 9/1969 | Kohl | 66/206 |
| 4,027,504 | 6/1977 | Dietschy | 66/64 |
| 4,399,670 | 8/1983 | Hittle et al. | 66/109 X |
| 4,852,369 | 8/1989 | Stoppazzini | 66/64 |
| 5,063,755 | 11/1991 | Shima et al. | 66/64 X |

FOREIGN PATENT DOCUMENTS

| | | | |
|---|---|---|---|
| 631109 | of 1968 | U.S.S.R. | 66/206 |
| 1084809 | of 1967 | United Kingdom | 66/206 |

*Primary Examiner*—Clifford D. Crowder
*Assistant Examiner*—Larry D. Worrell, Jr.
*Attorney, Agent, or Firm*—Edwin E. Greigg; Ronald E. Greigg

[57] ABSTRACT

The present invention relates to a flat knitting machine provided with swing sinkers and presser bars which can move into and out from a space provided between two needle beds in relative relationship so that they effectively urge the loops or stitches of yarn. Accordingly, both plain and rib knitting operations will be carried out with ease.

1 Claim, 7 Drawing Sheets

FLAT KNITTING MACHINE WITH SWING SINKERS AND PRESSER BARS

BACKGROUND OF THE INVENTION

The present invention relates to a flat knitting machine provided with swing sinkers and presser bars.

Such a flat knitting machine comprises a multiplicity of knitting needles arranged in a parallel relationship on needle beds and swing sinkers interposed between the knitting needles. The swing sinkers are provided with knitting yarn holding portions so that a row of stitches hooked on the knitting needles can be prevented from being lifted up when the knitting needles move upward for producing another row of stitches during the knitting operation. More particularly, the thread of yarn for knitting is maintained by the action of the knitting yarn holding portions of the swing sinkers and the chain of stitches looped on the knitting needles will be cleared off for knock-over action for knitting a succeeding chain.

It has been acknowledged that no specific device for lowering a chain of stitches is needed in the flat knitting machine provided with such sinkers. It is presumed that in plain knitting with the use of knitting needles of one of the two needle beds of the flat knitting machine, the foregoing action is successfully carried out with the help of the shape and mounting position of each sinker and the transfer of thread between the knitting needles.

However, it is found difficult to hold the chain of stitches with the knitting yarn holding portions of the swing sinkers in rib knitting, e.g. if knitting needles of two, front and rear, needle beds arranged facing each other are used or if the transfer thread of yarn between the knitting needles is short. For improvement, as shown in Japanese Patent Laid-open Publication No. 62-223348 knitting machines are provided with sinkers modified to the center area of an open space between the upper end of two needle beds when the sinkers go downward in order to securely hold a chain of stitches. The action of those sinkers is yet unsatisfied.

Also, it has been proposed that a knitted fabric presser device is arranged on the carriage for moving a presser bar thereof into the above space for holding the chain of stitches. However, the space is occupied by the projecting sinkers thus leaving less room which is too small to accept the presser bars. Accordingly, it is hardly feasible for a flat knitting machine in which each carriage is intended to change its moving direction at two desired positions on the corresponding needle bed to have a presser bar arranged for movement into and out from the space.

The present invention has been invented in view of the foregoing points and its object is to provide a flat knitting machine in which the swing sinkers and the presser bar are arranged for movement into and out from the space between the two needle beds in relative relationship so that either of the swing sinkers or the presser bar can act on the loops or knitted stitches of yard thus allowing both plain and rib knitting operations to be carried out equally with no trouble.

SUMMARY OF THE INVENTION

For achieving the above object, a flat knitting machine according to the present invention comprises: a multiplicity of knitting needles arranged on needle beds; sinkers provided between the knitting needles for swing movement; and carriages arranged to move leftward and rightward between two predetermined points on the needle beds, which can change their moving direction at two given points. In particular, each of the carriages has a sinker swing action controller and a stitch presser controller both linked to each other for co-movement and activated by a driver device directly coupled to the stitch presser controller. The stitch presser controller is coupled to a driver device for supporting a presser bar provided on the close-to-upper-end of the carriage. The presser bar is arranged for being moved into and out from a toothed opening provided between the top ends of the two needle beds by the action of the stitch presser controller. Also, the sinker swing action controller is arranged for actuating the sinkers in co-movement with the stitch presser controller. Accordingly, when the carriage changes its moving direction, both the presser bar and the sinkers are actuated to perform advancing and retracting actions relative to each other by the co-movement of the sinker swing action controller and the stitch presser controller.

In action, when the carriage changes its moving direction, the driver device actuates the stitch presser controller and then, the sinker swing action controller linked is to the stitch presser controller. Then, the presser bar of the stitch presser controller advances into the space provided between the uppermost ends of the two needle beds and presses down a knitted portion of fabric during rib knitting. In synchronism with the foregoing action, the sinkers are actuated to perform a swing action for opening the space which remains closed in a normal state. When the presser bar has moved into the space, the space is closed systematically. As the carriage moves in a given direction, the knitted fabric is urged downward.

When the carriages reach the other side of a stroke, the co-movement of the stitch presser controller and the sinker swing action controller triggered by the driver device causes the sinkers to open the space and the presser bar to move out from the space. As a result, the pressing of the presser bar over the knitted fabric is released.

As understood, the co-movement of the stitch presser controller and the sinker swing action controller triggered by the driver device allows the sinkers to perform a swing action which can also provide ease of displacing a row of stitches during plain knitting.

DETAILED DESCRIPTION OF THE INVENTION

Figure 1:
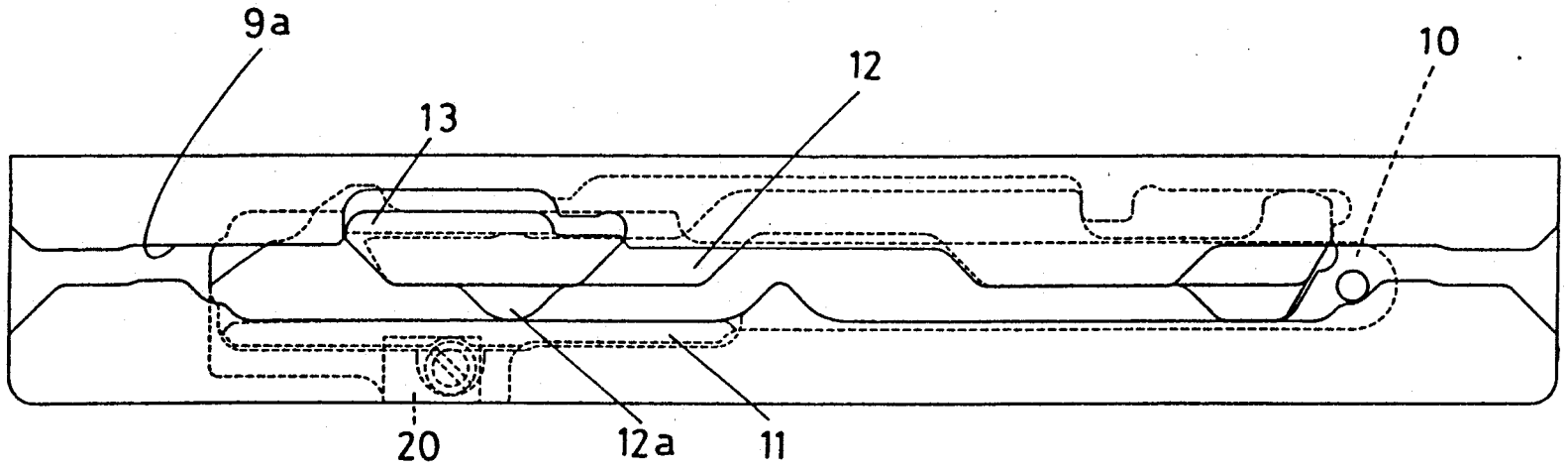
FIG. 1 is a plan view showing a primary part of an embodiment of the present invention.

One preferred embodiment of the present invention will be described referring to FIGS. 1 to 7.

A flat knitting machine comprises a pair of needle beds 1 (one of the pair only shown) arranged in an inverted-V form with their top ends facing each other and having a multiplicity of knitting needles (not shown) disposed thereon in parallel arrangement, a plurality of sinkers 2 mounted between the knitting needles for swing movement about wire rod 3 extending lengthwisely of the needle beds 1, and a couple of carriages 4 arranged for leftward and rightward movement between two predetermined points on respective needle beds 1, each carriage 4 being adapted to change its moving direction at a given point by means of a driver device. The carriage 4 is provided at upper left and right ends with a sinker swing action controller 5 for swing movement of the sinkers 2 and a stitch presser controller 7 for actuating a presser bar 6 respectively. The sinker swing action controller 5 and the stitch presser controller 7 are coupled to each other for linkage action. The stitch presser controller 7 is driven by a driver mechanism 8. The sinker swing action controller 5, the stitch presser controller 7, and the driver mechanism 8 all are installed in a housing bracket 9.

The housing bracket 9 has a sinker guide opening 9*a* arranged in a sinker-side wall thereof for clearing the lower end 2*a* of each sinker 2, as shown in FIGS. 1 to 4, which extends lengthwisely of the bracket 9. The sinker swing action controller 5 which is also disposed on the sinker-side of the carriage 2, comprises a swing rod 10 coupled at one end to the housing bracket 9 for pivotal movement, a guide rod 11 having a length of about a half the swing rod 10 and extending along the upper end of the sinker guide opening 9*a*, a sinker engaging guide rod 12 arranged partially abutting on the guide rod 11 and extending along the center of the sinker guide opening 9*a* for moving into and out from the opening 9*a*, and a guide cam 13 having an L shape in cross section and arranged for engagement with a lower raised portion 12*a* of the sinker engaging guide rod 12.

In action, the sinker swing action controller 5 is actuated by the movement of the stitch presser controller 7, which will be described in more detail later, thus to swing the swing rod 10. Accordingly, as the swing rod 10 carries out a swing action, the guide rod, 11, the sinker engaging guide rod 12, and the guide cam 13 are moved upward and downward thus actuating the sinkers 2. More specifically, the traveling of the carriage 4 triggers a combination movement of the guide rod 11, the sinker engaging guide rod 12, and the guide cam 13 which in turn actuates the lower end 2*a* of each sinker 2 held in the sinker guide opening 9*a* of the housing bracket 9 of the carriage 4 for swing action.

Meanwhile, the stitch presser controller 7 linked to the sinker swing action controller 5 for co-movement comprises a disk 14 fitted in eccentric arrangement onto a drive shaft 8*b* of a motor 8*a* of the driver mechanism 8, a connecting rod 15 having a rod portion 15*a* thereof and coupled to the disk 14, a swing connecting rod 16 fitted on the drive shaft 8*b* extending outward from the disk 14, another connecting rod 17 pivotably mounted at one end to the distal end of the swing connecting rod 16, a rotating support rod 18 pivoted at one end on the distal end of the rod portion 15*a* of the connecting rod 15 and at the end, pivotably coupled to the housing bracket 9 for rotating movement, a swing rod 19 pivotably mounted at one end to the distal end of the rod portion 15*a* coaxially of the rotating support rod 18, a further connecting rod 20 pivotably mounted at one end to the other end of the swing support rod 19 and at the other end, fixedly coupled to the swing rod 10, and a swing mechanism 21 for directly actuating the presser bar 6 for swing action.

The swing mechanism 21 comprises a couple of swing support rods 19 and 23 and a connecting action rod 24 for supporting the presser bar 6. The swing support rod 19 is pivotably mounted at one end to the sinker swing action controller 5 end of the housing bracket 9 and at the other end, pivotably coupled to the distal end of the connecting action rod 24. The other swing support rod 23 is disposed opposite to the sinker swing action controller 5 side and coupled at one end to the housing bracket 9 and at the other end, to the rear end of the connecting action rod 24 for pivotal linkage. In particular, the swing support rod 23 is coupled to the rear end of the connecting action rod 24 by a pivot pin 25 which is mounted on the distal end of the connecting rod 17.

Figure 2:
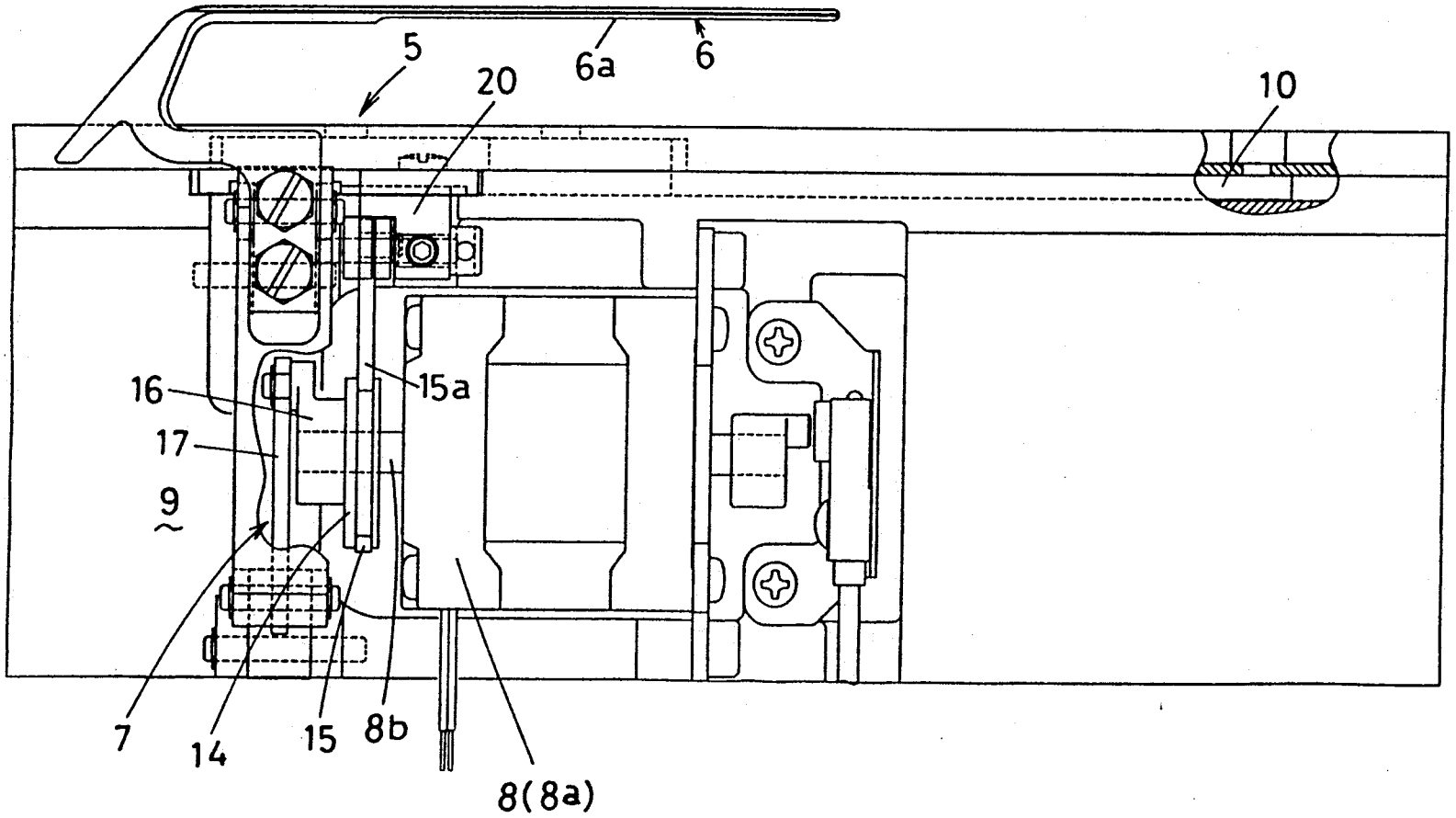
FIG. 2 is a partially cutoff enlarged front view of the same.
Figure 3:
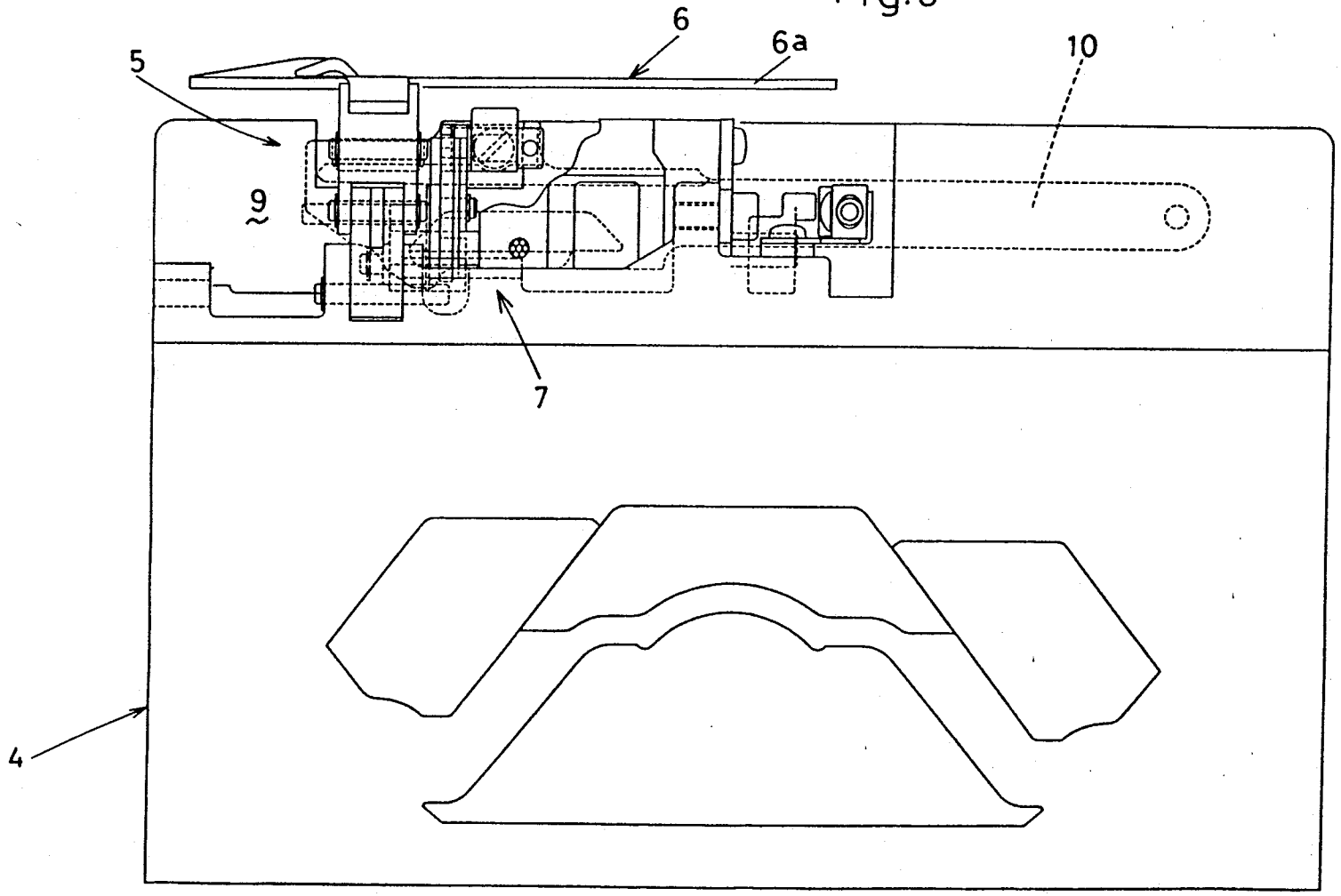
FIG. 3 is an explanatory view showing a carriage arranged according to the present invention.

The presser bar 6 is formed as shown in FIG. 2 in an approximately U shape and fixedly mounted at one end to the connecting rod 24. The presser bar 6 has a fabric press-down portion 6*a* thereof which extends along the top of the carriage 4 for moving into a toothed opening A between the two facing sinkers 2 of their respective needle beds 1 when they are opened.

Figure 4:
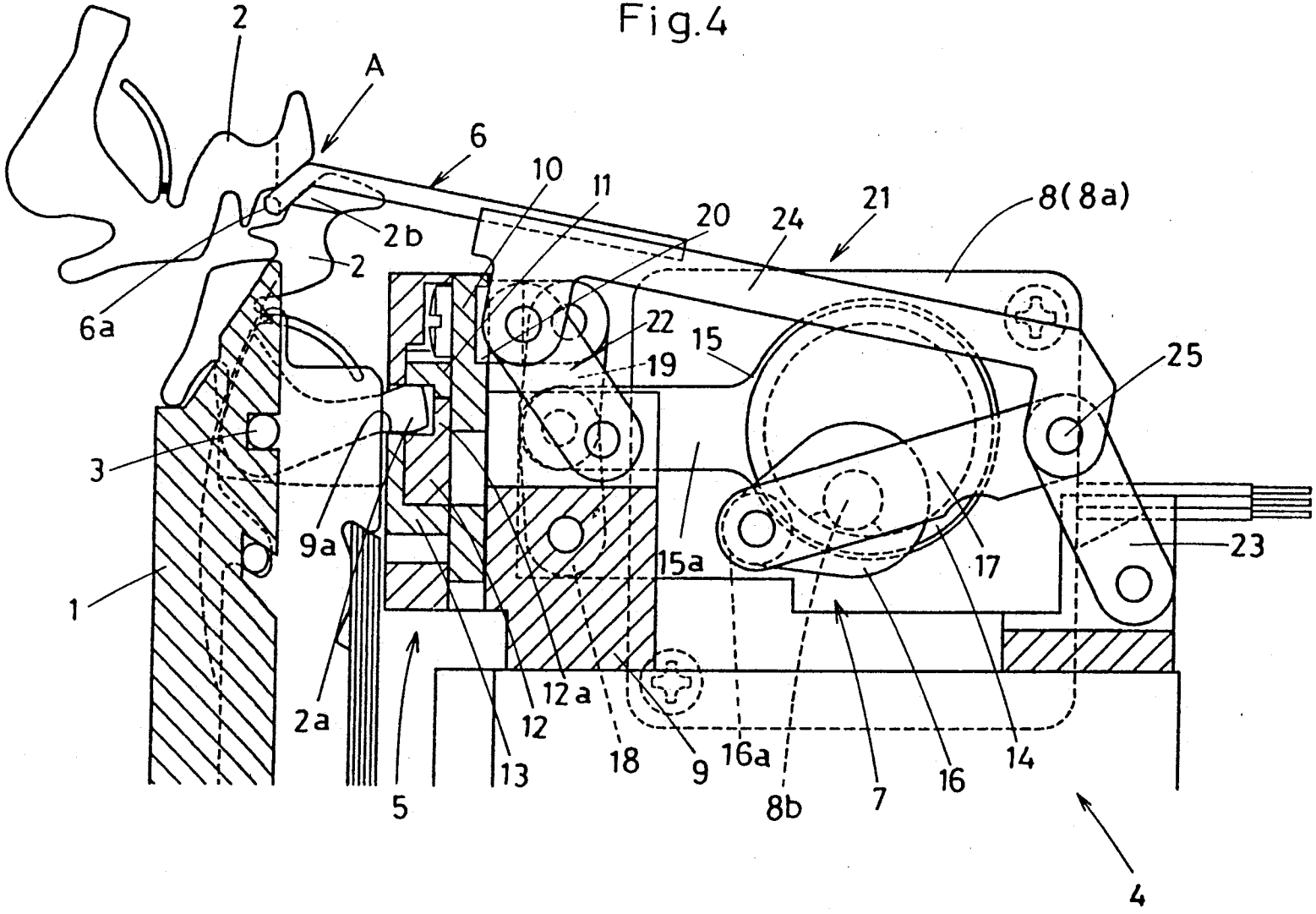
FIGS. 4 to 7 are explanatory views showing an action of the primary part.
Figure 5:
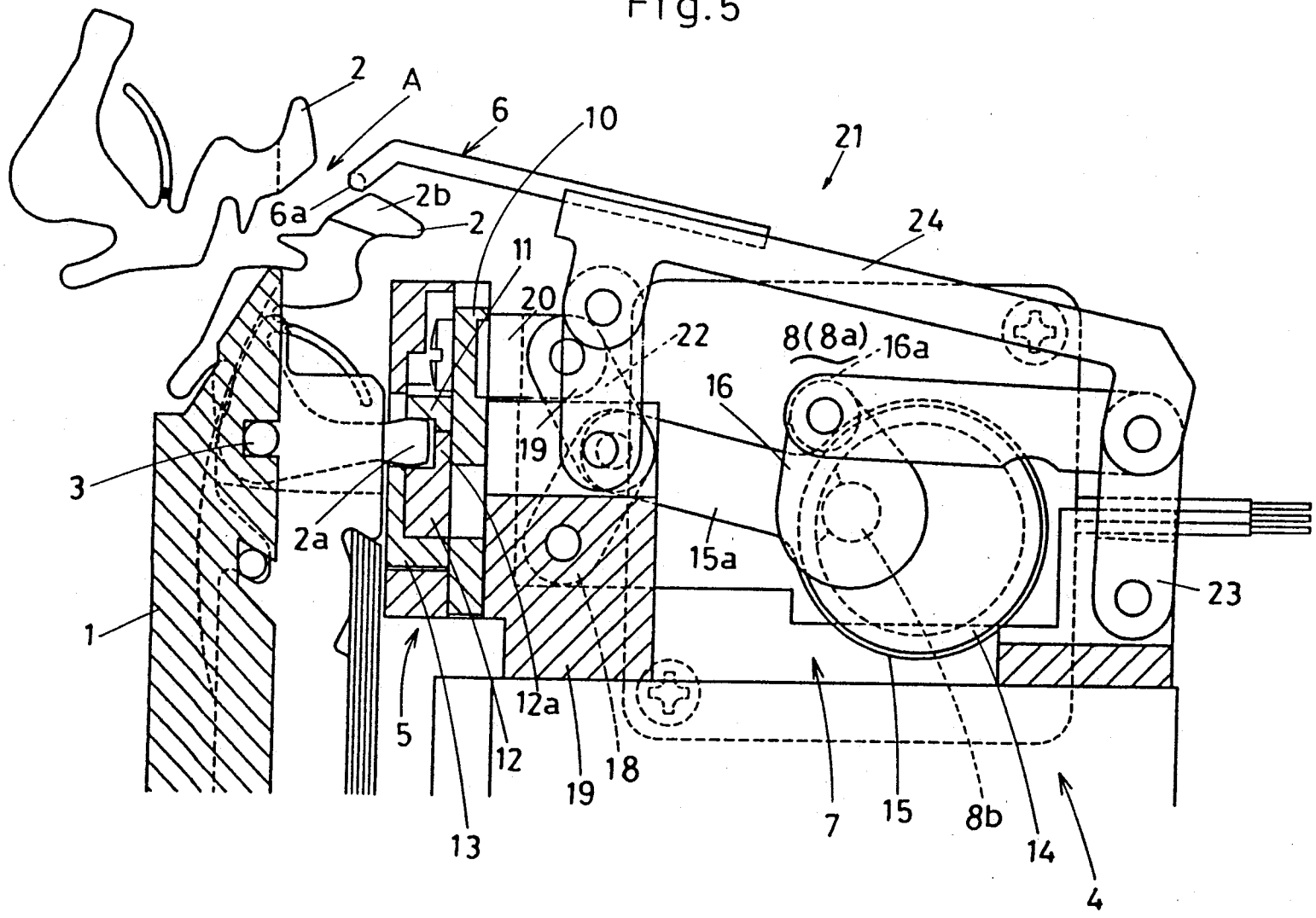
Figure 6:
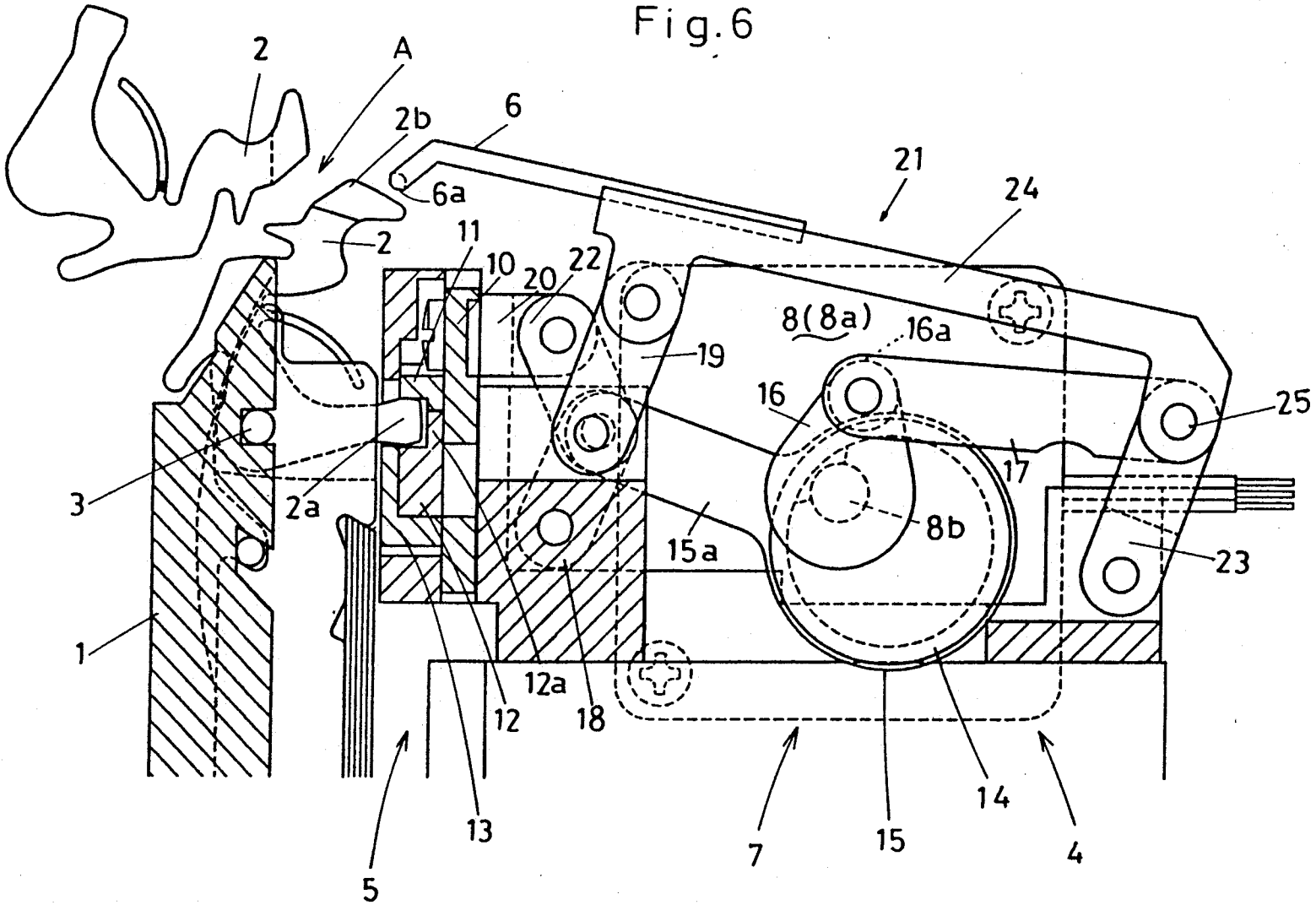
Figure 7:
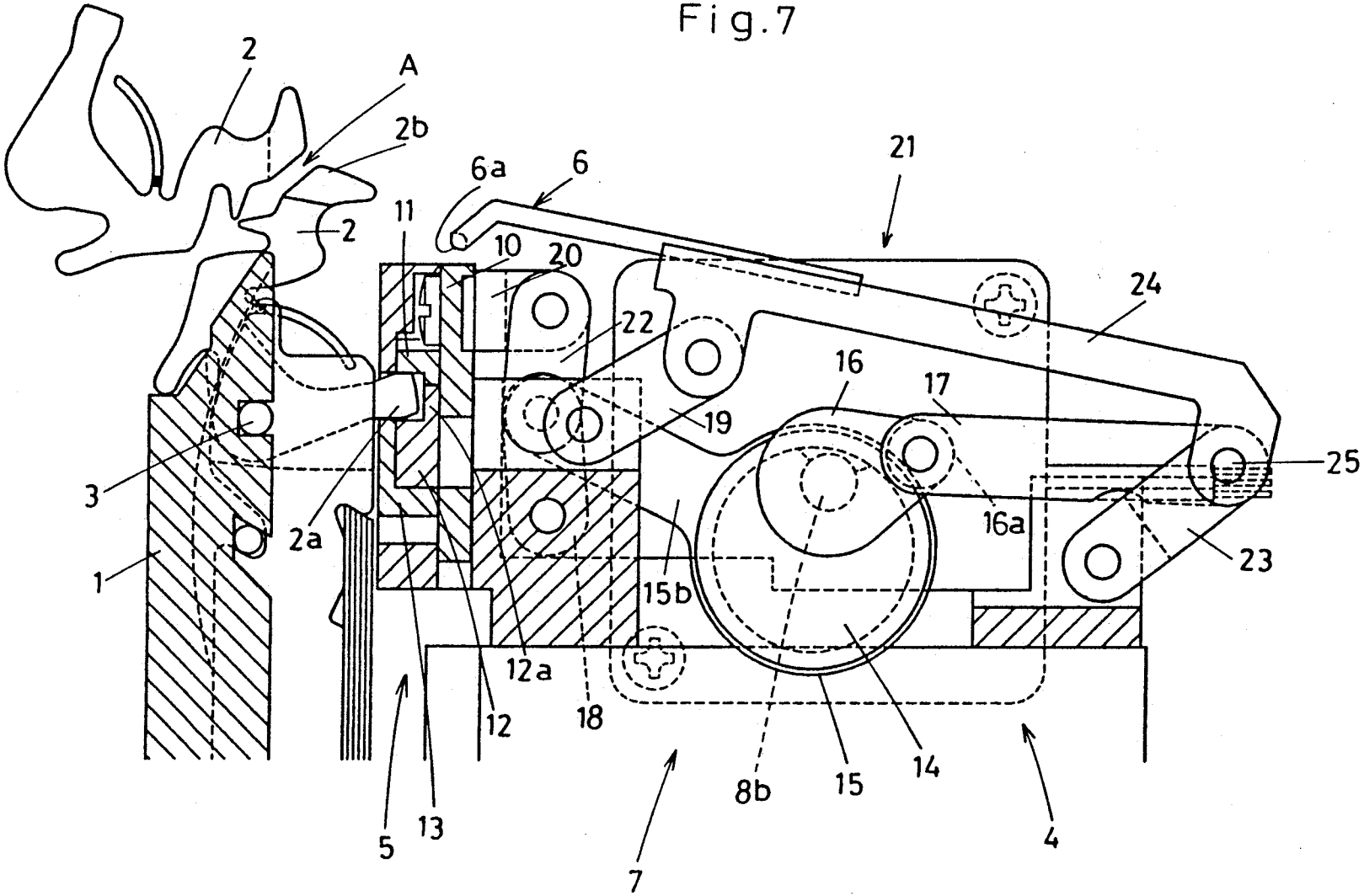

In action, when the drive motor 8*a* of the driver mechanism 8 is activated and its shaft 8*b* rotates during the running direction change action of the carriage 4 at a stoke limit, the distal end 16*a* of the swing connecting rod 16 comes to the sinker swing action controller 5 side as shown in FIG. 4. Then, the rear end of the connecting action rod 24 is pulled together with the swing support rod 23 towards the sinker swing action controller 5 by the action of the swing rod 19. Accordingly, the front end of the connecting action rod 24 pivoted on the swing support rod 19 moves towards the sinker 2 side. The fabric press-down portion 6*a* of the presser bar 6 supported by the connecting action rod 24 thus advances into the toothed opening A between the sinkers 2 and a fabric to be knitted is pressed downward from the toothed opening A as the carriage 4 travels in a given direction. During the foregoing movement, the toothed opening A between the sinkers 2 which is closed in a normal state is opened and then, closed.

More specifically, the rotation of the drive shaft 8*b* of the motor 8*a* actuates the disk 14 which then allows the rod portion 15*a* of the connecting rod 15 to move towards the sinker swing action controller 5. Hence, the rotating support rod 22 and the swing rod 18 coaxially coupled to the rod portion 15*a* come aligned in upward and downward directions and the connecting rod 20 pivotably coupled to the rotating support rod 22 moves upward. The guide rod 11, sinker engaging guide rod 12, and guide cam 13 are then lifted up by the action of the connecting rod 10 of the sinker swing action controller 5 coupled to the connecting rod 20. As the guide rod 11, sinker engaging guide rod 12, and guide cam 13 move upward, the lower end 2*a*, of each sinker 2 is turned upward about the music wire rod 3. Accordingly, the upper ends 2*b* of the two opposite sinkers 2 come close to each other thus closing the toothed opening A therebetween.

When the carriage 4 reaches the other stroke limit and changes its running direction, the presser bar 6 is retracted from the toothed opening A between the sinkers 2 by the action of the stitch presser controller 7 as shown in FIGS. 4 to 7. More particularly, as the drive shaft 8*b* of the motor 8*a* rotates clockwise, the front end of the swing connecting rod 16 turns from the upper to the right in the drawings. The connecting action rod 24 is thus moved away from the sinker swing action controller 5 by the connecting rod 17 and the presser bar 6 supported by the connecting action rod 24 retracts from the toothed opening A between the sinkers 2. Simultaneously, the sinkers 2 are actuated by the action of the sinker swing action controller 5 synchronized with the stitch presser controller 7 to open the toothed opening A.

Accordingly, the rod portion 15*a* of the connecting rod 15 moves away from the sinker swing action controller 5 as the drive shaft 8*b* of the motor 8*a* of the driver mechanism 8 is rotated clockwise. The movement of the connecting rod 19 causes the connecting rod 20 linked to the sinker swing action controller 5 to moves downward. As the connecting rod 20 moves downward, the connecting rod 10 of the sinker swing action controller 5 lowers the guide rod 11, sinker engaging guide rod 12, and guide cam 13 throughout the housing bracket 9. Then, the lower end 2*a* of each sinker 2 is moved down by the downward movement of the guide rod 11, sinker engaging guide rod 12, and guide cam 13. As a result, the upper ends 2*b* of the two opposite sinkers 2 are actuated to open the toothed opening A therebetween.

Further, in synchronism with the movement of the connecting action rod 24 supporting the presser bar 6 away from the sinker swing action controller 5, the swing rod 22 is tilted and pulled at the lower end towards the motor 8*a*, and is turned to a vertical position. This action of the swing rod 22 triggers, via the connecting rod 20, the lifting of the guide rod 11, sinker engaging guide rod 12, and guide cam 13 in the housing bracket 9. As the guide rod 11, sinker engaging guide rod 12, and guide cam 13 move upward, the lower end 2*a* of each sinker 2 is lifted up. As a result, the upper ends 2*a* of the two opposite sinkers 2 come close to each other to close the toothed opening A. By then, the presser bar 6 has been retracted from the toothed opening A between the sinkers 2.

As apparent from the above description, when the carriage 4 changes its running direction during the left- and rightward movement on the two needle beds 1 arranged in an inverted V form in cross section, the presser bar 6 advances into the toothed opening A between the two opposite sinkers 2 and presses down a knitted portion of fabric without disturbing the movement of the sinkers 2 associated with knitting the stitches.

What is claimed is:

1. A flat knitting machine having a multiplicity of knitting needles arranged on separate needle beds, sinkers swingably operable between each individual needle, said sinkers having a projecting portion at a upper end of each swingable sinker, said projecting portion covering an opening between two needle beds in a downward action, and carriages arranged to move leftward and rightward between two predetermined points on the needles beds comprising:

a stitch pressure controller (7) comprising;

a disk (14) driven by a driver mechanism (8), a swing connecting rod (16) fitted on a drive shaft (8*b*) that extends outward from the disk (14), a first connecting rod (17) pivotably mounted at one end of the swing connecting rod (16), a second connecting rod (15) coupled to the disk (14), a first rotating support rod (18) of which one end is pivotably coupled to a housing bracket (9) and the other end is pivotably mounted on an end of a rod portion (15*a*) of the second connecting rod (15), and a second rotating support rod (22) of which one end is pivotably mounted on an end of the rod portion (15*a*) of the second connecting rod (15) and the other end is pivotably mounted on an end of a third connecting rod (20);

a sinker swing action controller (5) comprising;

a swing rod (10) coupled to the third connecting rod (20) of the stitch presser controller (7), said swing rod (10) moving vertically according to a vertical movement of the second rotating support connecting rod (22), and a sinker (2) of which a lower end (2*a*) is guided upward and downward by a guide rod (11) and a sinker engaging guide rod (12) in accordance with a vertical movement of the swing rod (10);

a swing mechanism (21) comprising:

a first swing support rod (23) of which one end is pivotably coupled to a first housing bracket and the other end is connected to the first connecting rod (17) of the stitch presser controller (7), a second swing support rod (19) of which one end is pivotably coupled to a second housing bracket, a connecting action rod (24) of which one end is connected to another end of the second swing support rod (19) and the other end is connected to another end of the first swing support rod (23); and a presser bar (6) supported by the connecting action rod (24) which advances into and retracts from an opening (A) between the sinkers (2).

* * * * *